United States Patent [19]

Bruhn

[11] Patent Number: 4,610,624

[45] Date of Patent: Sep. 9, 1986

[54] HAND-OPERATED GAS LIGHTER

[76] Inventor: Hans-Peter Bruhn, Abteistrasse 41, D-2000 Hamburg 13, Fed. Rep. of Germany

[21] Appl. No.: 734,533

[22] Filed: May 16, 1985

[30] Foreign Application Priority Data

Dec. 15, 1984 [DE] Fed. Rep. of Germany ..... 8436764

[51] Int. Cl.[4] ..... F23Q 7/12

[52] U.S. Cl. ..... 431/255

[58] Field of Search ..... 431/255

[56] References Cited

U.S. PATENT DOCUMENTS

| | | | |
|---|---|---|---|
| 4,253,818 | 3/1981 | Ogawa et al. | 431/276 |
| 4,292,021 | 9/1981 | Miyagawa | 431/255 |
| 4,538,983 | 9/1985 | Zeller et al. | 431/255 |

FOREIGN PATENT DOCUMENTS

| | | |
|---|---|---|
| 2706762 | 8/1978 | Fed. Rep. of Germany . |
| 2754639 | 1/1979 | Fed. Rep. of Germany . |

*Primary Examiner*—Carroll B. Dority, Jr.
*Attorney, Agent, or Firm*—Charles W. Helzer

[57] ABSTRACT

A pistol-like hand-operated gas lighter comprises an elongated casing having an extended fuel supply/ignition tube secured to thereto in the manner of a barrel on a pistol. An electrically actuated igniter/burner is secured to the free end of the fuel supply/ignition tube. A liquid gas tank is contained within the elongated casing and has a gas tube leading from the tank through the fuel supply/ignition tube to the igniter/burner. An on-off valve is disposed on the tank. A piezoelectric generator is positioned in the elongated casing adjacent the on-off valve. A center balanced lever interconnects the on-off valve to the piezoelectric generator whereby upon the piezoelectric generator being physically operated, the valve is opened and allows fuel to flow through the gas tube to the igniter/burner. An electrical conductor extends from the igniter/burner through the extended fuel supply/ignition tube to within the elongated casing and an electrical connection is provided within the casing for electrically connecting the output electric potential from the piezoelectric generator to the electrical conductor upon the piezoelectric generator being operated. A spring-loaded trigger-like pusher element is physically secured to and serves to mechanically impact the piezoelectric generator. A wheel-actuated regulator valve is disposed on the tank.

4 Claims, 1 Drawing Figure

HAND-OPERATED GAS LIGHTER

BACKGROUND OF THE INVENTION

The present invention relates to a hand-operated gas lighter for igniting and making burn cookers, grills and open fires according to the preamble of claim 1.

The prior art discloses such hand-operated gas lighters in the most varied shapes and constructions. Reference is made in exemplified manner to German Pat. Nos. 2,706,762 and 2,754,639. However, a disadvantage of the known hand-operated gas lighters is the arrangement of the starting mechanism, pusher or trigger, which is operated with the thumb. Frequently, the prior art provides no flame regulation, or when this is provided it is complicated and requires the use of two hands.

SUMMARY OF THE INVENTION

The problem of the present invention is to so improve the aforementioned hand-operated gas lighter, that the indicated disadvantages are avoided and easy, fast operation is ensured. It is simultaneously intended to start and regulate the flame by a push-button and wheel with one hand, without it being necessary to use the other hand for this purpose.

This problem is solved by the hand-operated gas lighter characterized. Thus, a trigger-like pusher for the starting mechanism is provided, which is arranged in pistol-like manner directly adjacent to an ingnition tube projection, the front faces thereof running substantially in one plane. In addition, a flame regulator in the form of a wheel is formed on the side opposite to the pusher with respect to the ignition tube and which is set back somewhat with respect to the projection. When the operator grasps the casing, he or she can simultaneously operate the pusher with the index finger and turn the regulating wheel in the desired direction with the thumb of the same hand, in order to make the flame larger or smaller. According to the invention, the pusher and flame regulator are so far away from the flame, that there is no risk of the index finger or thumb being burned.

Even though the represented embodiment shows a refillable hand-operated gas lighter, it is readily apparent that the invention also extends to disposable gas lighters.

Further advantages and features can be gathered from the subclaims.

BRIEF DESCRIPTION OF THE DRAWING

The invention is described in greater detail hereinafter relative to a preferred, non-limitative embodiment with reference to the attached FIG. 1, which is a diagrammatic cross-sectional view of a hand-operated gas lighter according to the invention.

DETAILED DESCRIPTION OF THE PREFERRED EMBODIMENT

Figure 1:
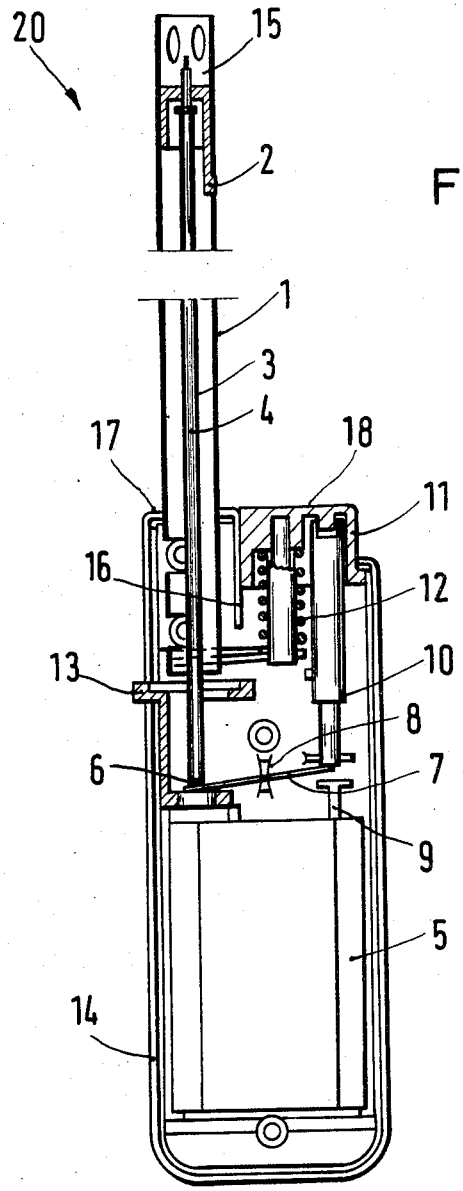

In FIG. 1, the hand-operated gas lighter according to the invention is defined by the general reference 20. It is used for igniting and making burn cookers, grills and open fires and consequently has a particularly long, round fuel supply/ignition tube 1, on whose front end an igniter burner 15 is arranged in a burner holder 2. A gas tube 3 with a copper conductor line 4 is centrally arranged in fuel supply/ignition tube 1. Over approximately quarter of its length, fuel supply and ignition tube 1 runs in casing 14, which is elongated and narrow. The longitudinal edges and rear edge of casing 14 has an identical radius, which corresponds to half the casing thickness. The fuel supply/ignition tube 1 is located in an ignition tube projection 16 of casing 14, directly adjacent to whose inner casing side is provided a trigger-like pusher 11 as a starting device. The front faces 17, 18 of projection 16 or pusher 11 are located in essentially one horizontal plane. On the outer side of projection 16 and set back somewhat with respect to the latter and front face 17 is provided flame regulator 13 in the form of a wheel-actuated regulator valve, so that it can easily be turned with the thumb, whilst the index finger simultaneously operates the trigger-like pusher 11. This ensures easy, rapid operation and an esthetic external appearance. The liquid gas tank 5 is located at the rear end of casing 14 and is connected to the gas tube 3 by means of mushroom head on-off valve means 6 of known construction. Between the latter and tank 5 is arranged a valve lever 7 for opening and closing on-off valve 6. Lever 7 is positioned on a bearing block 8, said lever terminating at the opposite end between stop member 9 and the actual electric arc-striking mechanism 10.

As can be gathered from the drawing, the trigger-like pusher element 11 seats and moves mechanism 10 which is a piezoelectric generator switch of known construction. Pusher 11 is biased by a spring 12 which has a double function, i.e. it always keeps the pusher 11 pretensioned in the front end position and also permits or provides an electrically conductive connection between the piezoelectric striking mechanism 10 and the conductor 4 in fuel supply/ignition tube 1 in the depressed position. Furthermore, as a result of conductor line 4, which is bent into the gas tube 3 in the form of a bare, copper-stranded wire, there is no need for an independently insulated line between the piezoelectric striking mechanism 10 and burner 15.

It is finally pointed out that the flame regulator valve 13 in the form of a wheel is rotatable at right angles to the longitudinal axis of casing 14. The invention also covers others arrangements, e.g. in the longitudinal direction of the casing.

What is claimed is:

1. A pistol-like hand-operated gas lighter for igniting and making burn cookers, grills and open fires and the like with a liquid fuel comprising an elongated casing, an extended fuel supply/ignition tube secured to the casing in the manner of a barrel on a pistol, an electrically actuated igniter/burner secured to the free end of the fuel supply/ignition tube, a liquid gas tank contained within the elongated casing and having a gas tube leading from the liquid gas tank through the fuel supply/ignition tube to the igniter/burner, on-off valve means positioned on the gas tank in the elongated casing, piezoelectric generator means positioned in the elongated casing adjacent the on-off valve means, lever means mechanically interconnecting said on-off valve means and said piezoelectric generator means whereby upon acutation of the piezoelectric generator means, the on-off valve means is opened and allows fuel to flow through the gas tube to the igniter/burner, an electrical conductor extending from the igniter/burner through the extended fuel supply/ignition tube to within the elongated casing, means within the elongated casing for electrically connecting the output electric potential from the piezoelectric generator means to the said electrical conductor upon the piezoelectric generator means being actuated to thereby produce an electric arc in the igniter/burner, starting means comprising a spring-loaded trigger-like pusher element arranged on the end of the elongated casing immediately below the extended fuel supply/ignition tube in the manner of a trigger, said trigger-like pusher element being physically secured to and serving to actuate the piezoelectric generator means upon being depressed in the manner of a trigger, and wheel actuated regulator valve means supported on said elongated casing for regulating the flow rate of fuel through the gas tube, said wheel of said regulator valve means extending through a side of said elongated casing on the same end thereof and at a point close to but set back somewhat with respect to the trigger-like pusher element whereby an operator can simultaneously actuate and regulate the gas lighter by pulling the trigger-like pusher element with the index finger and rotating the wheel-actuated regulator valve means with the thumb of the same hand.

2. A hand-operated gas lighter according to claim 1 wherein the trigger-like pusher element linearly moves the piezoelectric generator means in and out to actuate the same and there is only a single lever-like link required to transmit mechanical motion to the on-off valve means whereby frictional forces and mechanical losses in the lighter are reduced to a minimum along with the number, complexity and cost of the components employed in the lighter.

3. A hand-operated gas lighter according to claim 1 wherein the means mechanically interconnecting the on-off valve means and the piezoelectric generator means comprises a partially rotatable lever linkage member center supported within the elongated casing with one end secured to and operating the on-off valve means between its open-on position and its closed-off position, and with the other end effectively coupled to and moved by the trigger-like pusher element in concert with the piezoelectric generator switch means.

4. A hand-operated gas lighter according to claim 2 wherein the means mechanically interconnecting the on-off valve means and the piezoelectric generator means comprises a partially rotatable lever linkage member center supported within the elongated casing with one end secured to and operating the on-off valve means between its open-on position and its closed-off position, and with the other end effectively coupled to and moved by the trigger-like pusher element in concert with the piezoelectric generator means.

* * * * *